US011258196B2

(12) United States Patent
Kim et al.

(10) Patent No.: US 11,258,196 B2
(45) Date of Patent: Feb. 22, 2022

(54) CONNECTOR ASSEMBLY AND HOME APPLIANCE INCLUDING THE CONNECTOR ASSEMBLY

(71) Applicant: Tyco Electronics AMP Korea Co., Ltd., Gyungsan-si (KR)

(72) Inventors: Sung Chul Kim, Gyungsan-si (KR); Byung Hee Cho, Gyungsan-si (KR); Suk Eun Jung, Gyungsan-si (KR); Ki Deok Cheon, Gyungsan-si (KR)

(73) Assignee: Tyco Electronics AMP Korea Co., Ltd., Gyungsangbuk-do (KR)

( * ) Notice: Subject to any disclaimer, the term of this patent is extended or adjusted under 35 U.S.C. 154(b) by 0 days.

(21) Appl. No.: 16/743,644

(22) Filed: Jan. 15, 2020

(65) Prior Publication Data

US 2020/0227857 A1 Jul. 16, 2020

(30) Foreign Application Priority Data

Jan. 15, 2019 (KR) ..... 10-2019-0005146
Jan. 7, 2020 (KR) ..... 10-2020-0001819

(51) Int. Cl.
*H01R 13/436* (2006.01)
*H01R 13/627* (2006.01)

(52) U.S. Cl.
CPC ..... *H01R 13/4367* (2013.01); *H01R 13/6272* (2013.01)

(58) Field of Classification Search
CPC ..... H01R 13/4367; H01R 13/4368; H01R 13/6271–6273
USPC ..... 439/752, 595, 357, 358
See application file for complete search history.

(56) References Cited

U.S. PATENT DOCUMENTS 4,758,182 A * 7/1988 Anbo ..... H01R 13/4368 439/271
4,891,021 A * 1/1990 Hayes ..... H01R 13/114 439/595
5,017,162 A * 5/1991 Krehbiel ..... H01R 13/42 439/599
5,059,142 A * 10/1991 Ohta ..... H01R 13/4368 439/752
5,120,269 A * 6/1992 Endo ..... H01R 13/4368 439/595
5,322,456 A * 6/1994 Yagi ..... H01R 13/4368 439/595
5,322,457 A * 6/1994 Tsuji ..... H01R 13/4368 439/595
5,520,553 A * 5/1996 Cecil, Jr. ..... H01R 13/4365 439/595
5,575,692 A * 11/1996 Cecil, Jr. ..... H01R 13/4368 439/752

(Continued)

*Primary Examiner* — Gary F Paumen
(74) *Attorney, Agent, or Firm* — Barley Snyder

(57) ABSTRACT

A connector assembly includes a cap housing in which a first terminal is disposed, a plug in which a second terminal is disposed, and a terminal position assurance (TPA) member. The plug has a first end portion and a second end portion opposite the first end portion. The second end portion is inserted into the cap housing. A first end portion of the cap housing and the first end portion of the plug to which a wire is connected are each a coupling target. The TPA member is disposed at the coupling target. The TPA member includes a first block and a second block partitioned from one another in a circumferential direction of the wire.

25 Claims, 5 Drawing Sheets

(56) References Cited

U.S. PATENT DOCUMENTS

| | | | | | |
|---|---|---|---|---|---|
| 5,803,773 | A * | 9/1998 | Kashiyama | H01R 13/4368 | 439/752 |
| 6,045,404 | A * | 4/2000 | Myer | H01R 13/4223 | 439/595 |
| 6,059,602 | A * | 5/2000 | Ward | H01R 13/432 | 439/465 |
| 6,755,688 | B2 * | 6/2004 | Hall | H01R 13/4364 | 439/595 |
| 7,850,476 | B2 * | 12/2010 | Good | H02S 40/36 | 439/358 |
| 7,909,638 | B2 * | 3/2011 | Seo | H01R 13/6272 | 439/489 |
| 2005/0227548 | A1 * | 10/2005 | Sian | H01R 13/424 | 439/752 |
| 2019/0140389 | A1 * | 5/2019 | Yl | H01R 13/4362 | |

* cited by examiner

CONNECTOR ASSEMBLY AND HOME APPLIANCE INCLUDING THE CONNECTOR ASSEMBLY

CROSS-REFERENCE TO RELATED APPLICATIONS

This application claims the benefit of the filing date under 35 U.S.C. § 119(a)-(d) of Korean Provisional Patent Application No. 10-2019-0005146, filed on Jan. 15, 2019, and Korean Patent Application No. 10-2020-0001819, filed on Jan. 7, 2020.

FIELD OF THE INVENTION

The present invention relates to a connector assembly and, more particularly, to a connector assembly including a terminal position assurance member.

BACKGROUND

A connector assembly may be provided in a space filled with a foaming member for thermal insulation as, for example, in a refrigerator. In general, a foaming member is hardened after being injected in the form of liquid. Thus, when the space is filled with the foaming member, the foaming member may infiltrate into the connector assembly provided in the space.

Even when a sealing structure is adopted to prevent the foaming member from infiltrating into the connector assembly, it is impossible to achieve sufficient sealing of the connector assembly due to the characteristic of the foaming member and the filling pressure. For example, in a case of a water-resistant connector, a foaming member may infiltrate through a gap between sealing members such as wire seals, peripheral seals, O-ring seals, grommets, and gaskets. Further, in a case of a non-water-resistant connector, a foaming member may infiltrate into a connector assembly through a bonded portion even when the connector assembly is sealed with tapes, sponges, or glues.

The above description has been possessed or acquired by the inventor(s) in the course of conceiving the present invention and is not necessarily an art publicly known before the present application is filed.

SUMMARY

A connector assembly includes a cap housing in which a first terminal is disposed, a plug in which a second terminal is disposed, and a terminal position assurance (TPA) member. The plug has a first end portion and a second end portion opposite the first end portion. The second end portion is inserted into the cap housing. A first end portion of the cap housing and the first end portion of the plug to which a wire is connected are each a coupling target. The TPA member is disposed at the coupling target. The TPA member includes a first block and a second block partitioned from one another in a circumferential direction of the wire.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
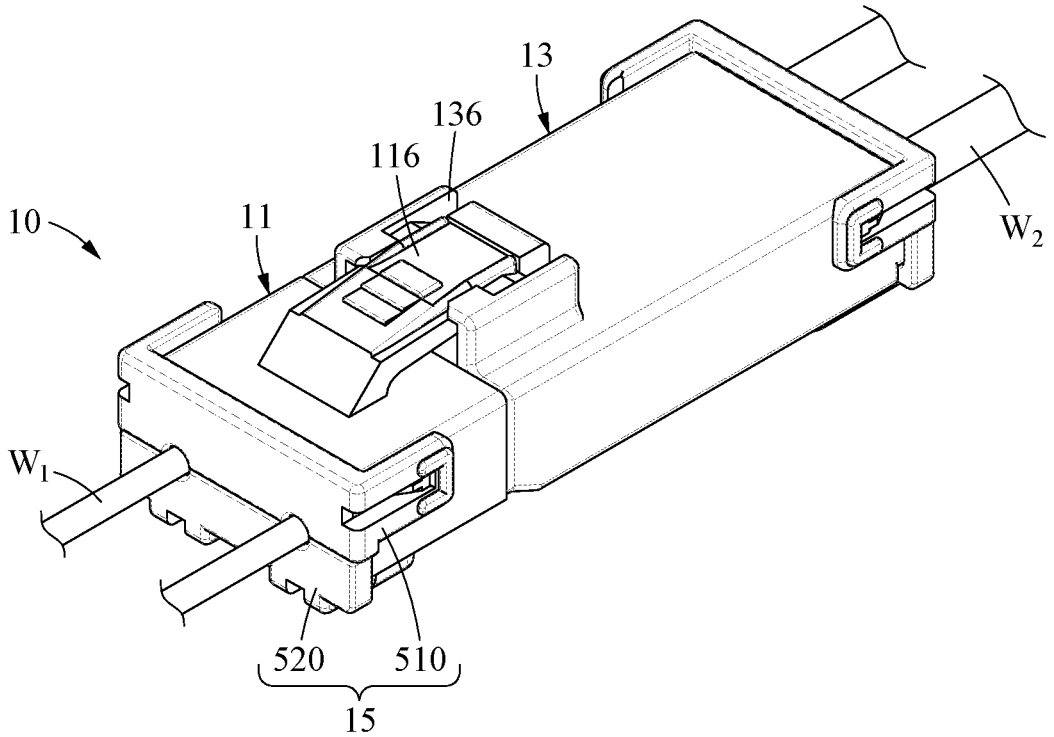
FIG. 1 is a top perspective view of a connector assembly according to an embodiment.

Hereinafter, embodiments will be described in detail with reference to the illustrative drawings. In denoting reference numerals to constituent elements of the respective drawings, it should be noted that the same constituent elements will be designated by the same reference numerals, if possible, even though the constituent elements are illustrated in different drawings. Further, in the following description of the present embodiments, a detailed description of publicly known configurations or functions incorporated herein will be omitted when it is determined that the detailed description obscures the subject matters of the present embodiments.

In addition, the terms first, second, A, B, (a), and (b) may be used to describe constituent elements of the embodiments. These terms are used only for the purpose of discriminating one constituent element from another constituent element, and the nature, the sequences, or the orders of the constituent elements are not limited by the terms. When one constituent element is described as being "connected", "coupled", or "attached" to another constituent element, it should be understood that one constituent element can be connected or attached directly to another constituent element, and an intervening constituent element can also be "connected", "coupled", or "attached" to the constituent elements.

The constituent element, which has the same common function as the constituent element included in any one embodiment, will be described by using the same name in other embodiments. Unless disclosed to the contrary, the configuration disclosed in any one embodiment may be applied to other embodiments, and the specific description of the repeated configuration will be omitted.

A connector assembly 10 according to an embodiment is shown in FIGS. 1-5. The connector assembly 10 includes a plug 11, a cap housing 13, and a terminal position assurance (TPA) member 15 coupled to an end portion of the plug 11 and an end portion of the cap housing 13.

Figure 3:
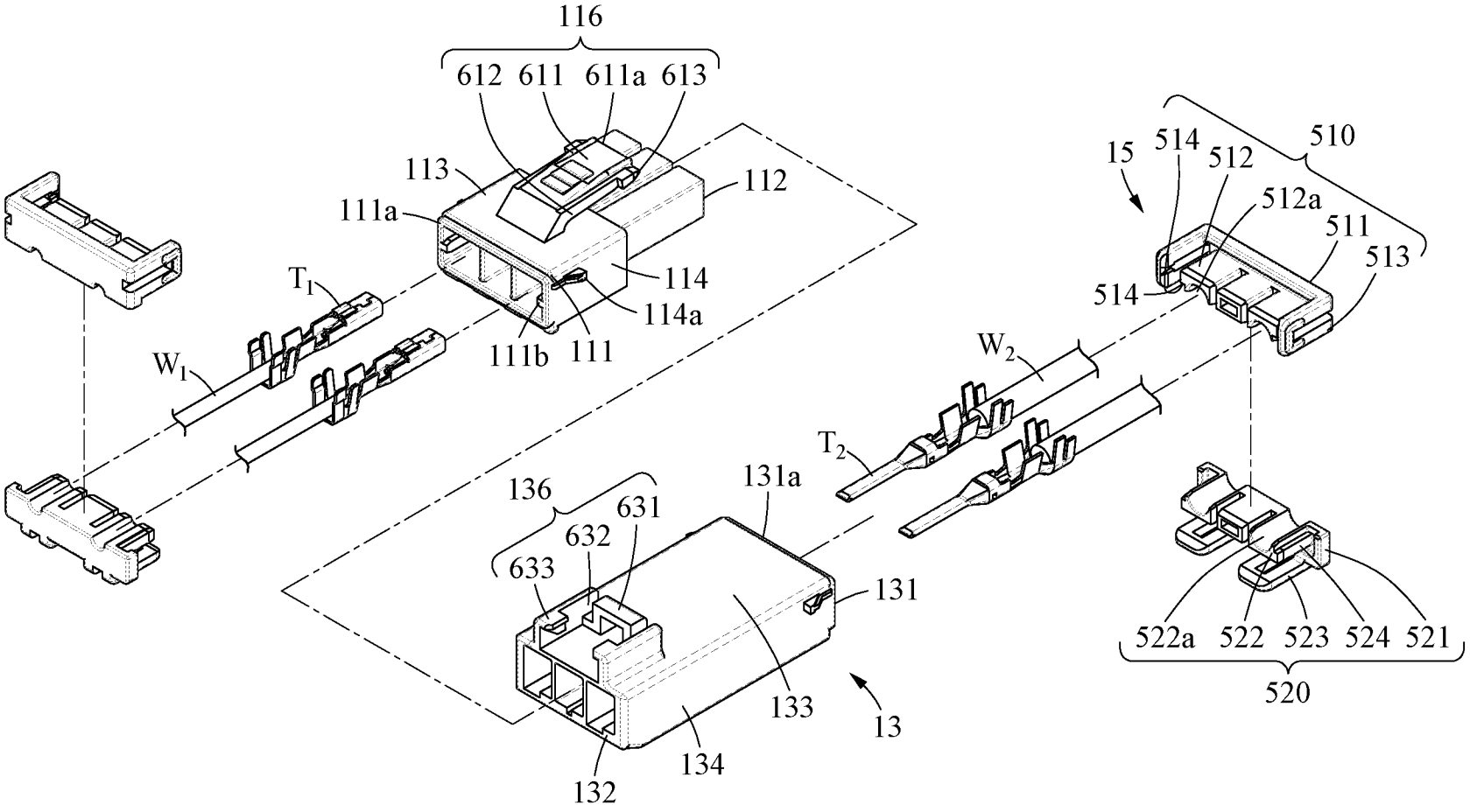
FIG. 3 is an exploded perspective view of the connector assembly of FIG. 1.

As shown in FIG. 3, an end portion of the plug 11 into which a first terminal (hereinafter, referred to as the receptacle terminal T1) is inserted will be referred to as a first end portion 111, and a portion of the plug 11 on the opposite side of the first end portion 111 and coupled to the cap housing 13 will be referred to as a second end portion 112. Similarly, an end portion of the cap housing 13 into which a second terminal (hereinafter, referred to as the tap terminal T2) is inserted will be referred to as a first end portion 131, and a portion of the cap housing 13 on the opposite side of the first end portion 131 and coupled to the plug 11 will be referred to as a second end portion 132. In the following, with regard to the plug 11 and the cap housing 13, top surfaces 113 and 133, side surfaces 114 and 134, and bottom surfaces 115 and 135 will be described based on the orientation shown in FIG.

1. In addition, upward and downward/leftward and rightward/backward and forward directions of the connector assembly 10 will be described based on the orientation shown in FIG. 1.

A plurality of receptacle terminals T1 and wires W1 may be provided at the first end portion 111 of the plug 11, and the TPA member 15 may be provided at the first end portion 111, as shown in FIGS. 1-5. The second end portion 112 of the plug 11 may be inserted into and coupled to the cap housing 13, and a portion of the first end portion 111 may be externally exposed. A plurality of tap terminals T2 and wires W2 may be provided at the first end portion 131 of the cap housing 13, and the TPA member 15 may be provided at the first end portion 131.

When the plug 11 and the cap housing 13 are coupled, the plurality of receptacle terminals T1 and the plurality of tap terminals T2 may be respectively electrically connected therein.

A foaming member may infiltrate into the connector assembly 10 due to a characteristic of being injected in the form of liquid and the filling pressure. For example, the foaming member may infiltrate into the connector assembly 10 through a portion in which the plug 11 and the cap housing 13 are coupled. Because the plug 11 is inserted into the cap housing 13 in a longitudinal direction, the length of the portion in which the plug 11 and the cap housing 13 are coupled is increased. Thus, the length of a path along which the foaming member infiltrates increases, whereby it is possible to prevent the foaming member infiltrating into the connector assembly 10.

To couple the plug 11 and the cap housing 13 more firmly and maintain the coupling state, the plug 11 and the cap housing 13 may respectively include a first locking portion 116 and a second locking portion 136, as shown in FIGS. 1-5. The first locking portion 116 may be formed on the top surface 113 of the plug 11, and the second locking portion 136 corresponding to the first locking portion 116 may be formed on the top surface 133 of the cap housing 13.

Figure 4:
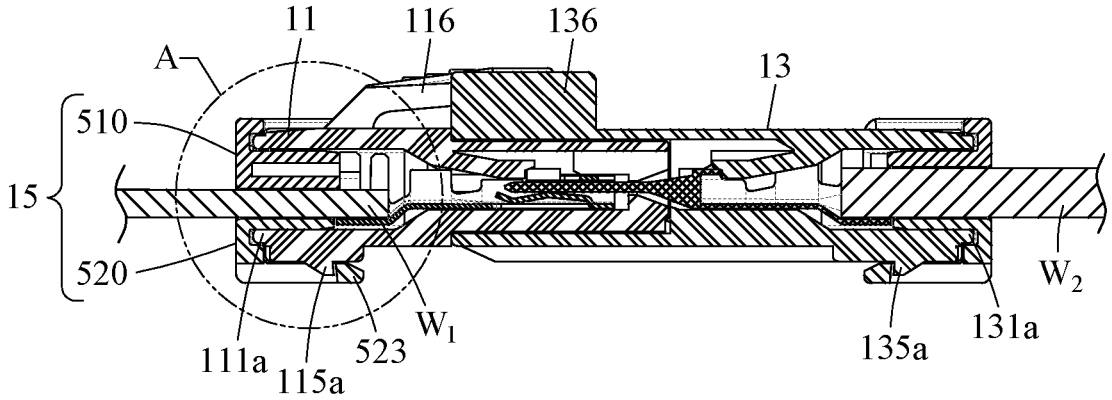
FIG. 4 is a sectional side view of the connector assembly of FIG. 1.

The first locking portion 116, in the embodiment shown in FIGS. 1, 3, and 4, is an outer latch having an elasticity and provided approximately in the form of a cantilever that extends toward a direction in which the plug 11 is coupled to the cap housing 13. The first locking portion 116 may include a latch frame 611 and a plurality of movable portions 612.

One end of the latch frame 611, as shown in FIG. 3, may be fixed to the top surface 113 of the plug 11, and the other end thereof may be provided in the shape of a cantilever that extends toward the cap housing 13 and has a predetermined width.

The movable portions 612, as shown in FIG. 3, may be formed to be separated from the latch frame 611 and parallel therewith, and include hooks 613 at end portions thereof. The movable portions 612 may be spaced apart from the latch frame 611 by a predetermined distance in the direction in which the latch frame 611 extends. By forming the movable portions 612 as described above, when the first locking portion 116 is pushed into the second locking portion 136, the movable portions 612 may be elastically deformed and the first locking portion 116 may be fastened to the second locking portion 136. Forming the movable portions 612 to be parallel with the latch frame 611 may indicate forming the movable portions 612 and the latch frame 611 to extend approximately in the same direction toward the cap housing 13, and may not indicate being totally parallel.

The second locking portion 136, shown in FIGS. 1, 3, and 4, protrudes from the top surface 133 of the cap housing 13 and is locked with the first locking portion 116. The second locking portion 136 includes a stopper 631 and a partition wall 632 including a plurality of securing protrusions 633 to be coupled to the movable portions 612.

The stopper 631, as shown in the embodiment of FIG. 3, may be formed at a position contacted by an end portion 611*a* of the latch frame 611 when the first locking portion 116 and the second locking portion 136 are coupled, and may thereby restrict the first locking portion 116 not to be inserted further in a direction in which the first locking portion 116 is coupled to the second locking portion 136.

The partition wall 632, as shown in the embodiment of FIG. 3, may be a flange erected to be approximately perpendicular to the top surface 133 of the cap housing 13, and may be formed on a more outer side than the movable portions 612. That is, the first locking portion 116 may be inserted into an inner space formed by a pair of partition walls 632 and fastened to the second locking portion 136.

The securing protrusions 633 protruding a predetermined height may be formed on inner sides of the partition wall 632, as shown in FIG. 3, such that the hooks 613 of the movable portions 612 may be caught by the securing protrusions 633. The movable portions 612 may include the hooks 613 formed outward so as to be caught by the securing protrusions 633.

In other embodiments, the first locking portion 116 and the second locking portion 136 may be provided in various shapes to be fastened to each other to maintain a coupling state of the plug 11 and the cap housing 13 when the plug 11 and the cap housing 13 are coupled. Further, although the first locking portion 116 and the second locking portion 136 are each formed at a single location in the present example embodiment, the first locking portion 116 and the second locking portion 136 may be formed at two or more locations, for example, on the bottom surfaces 115 and 135 or on the side surfaces 114 and 134, as well as on the top surfaces 113 and 133 of the connector assembly 10.

The TPA member 15, as shown in FIGS. 1-5, may be provided in each of the first end portion 111 of the plug 11 and the first end portion 131 of the cap housing 13. The TPA member 15 may be inserted into the plug 11 from the first end portion 111 of the plug 11 along the wires W1, thereby blocking the first end portion 111 and simultaneously fixing the wires W1 to the plug 11. Similarly, the TPA member 15 may be inserted into the cap housing 13 from the first end portion 131 of the cap housing 13 along the wires W2, thereby blocking the first end portion 131 of the cap housing 13 and simultaneously fixing the wires W2 to the cap housing 13.

Hereinafter, because the TPA member 15 provided in the plug 11 and the TPA member 15 provided in the cap housing 13 are substantially the same, the TPA members 15 will be collectively referred to as "the TPA member 15", rather than separately described. Further, an example in which a coupling target to be coupled with the TPA member 15 is only the plug 11 will be described hereinafter. However, the cap housing 13 and the TPA member 15 have substantially the same coupling, and thus duplicate description will be omitted.

The TPA member 15 may be divided into two blocks as shown in FIGS. 1-5; a first block 510 and a second block 520. The second block 520 may be formed in symmetry with the first block 510 with respect to the circumferential direction of the wires W1. The first and second blocks 510 and 520 may have structures that engage with each other in the plug 11, with the wires W1 therebetween.

The first block 510, as shown in FIGS. 1-5, includes a first frame 511, a plurality of first wire guides 512 including approximately semi-cylindrical wire connecting grooves 512*a* to be coupled to the wires W1, and a first latch 513 to be coupled to the plug 11. The first frame 511 may be provided approximately in the form of a plate and coupled to block the first end portion 111 of the plug 11. The first wire guides 512 may extend a predetermined length from the first frame 511 toward the plug 11, and include the wire connecting grooves 512*a* to fit the outer circumferences of the wires W1 on the surface thereof. For example, two first wire guides 512 and two wire connecting grooves 512*a* may be formed to be parallel in a longitudinal direction of the wires W1, so as to independently contact the wires W1.

A pair of first latches 513 may extend from both end portions of the first frame 511 toward the plug 11 and be locked with both side surfaces 114 of the plug 11. For example, protruding portions 114*a* and 134*a* protruding a predetermined height may be formed on the side surface 114 of the plug 11 (and the cap housing 13), and the first latches 513 may be provided in the shape of loops to be locked and fastened with the protruding portions 114*a* and 134*a*. When the first block 510 is inserted into the plug 11, the first wire guides 512 may be inserted into the plug 11 and fasten the upper portion of the outer circumferences of the wires W1, and the first latches 513 may be fastened to both side surfaces 114 of the plug 11 and thereby elastically support the coupling state of the first block 510 and the plug 11.

The second block 520, as shown in FIGS. 1-5, includes a second frame 521, a plurality of second wire guides 522 corresponding to the first wire guides 512 and to be coupled to the remaining outer circumferences of the wires W1, and a second latch 523 to be coupled to the plug 11. The second frame 521 may be provided approximately in the form of a plate and coupled to block the first end portion 111 when the second block 520 is coupled to the plug 11. The first frame 511 and the second frame 521 may be coupled to be on the same plane. The second wire guides 522 may extend a predetermined length from the second frame 521 toward the plug 11, and include second wire connecting grooves 522*a* such that the wires W1 may fit between the second wire guides 522 and the first wire guides 512.

Figure 2:
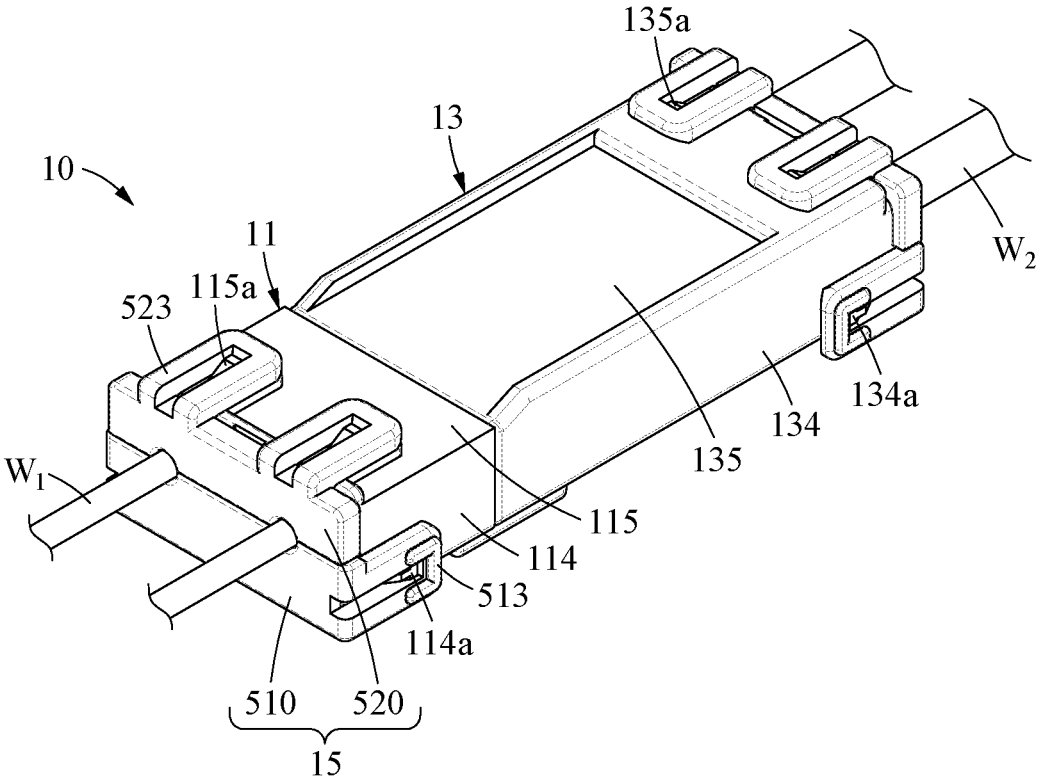
FIG. 2 is a bottom perspective view of the connector assembly of FIG. 1.

The second latch 523 may extend from the second frame 521 toward the plug 11. The second latch 523 may be formed to be fastened to the bottom surface 115 (and the bottom surface 135) of the outer side of the plug 11, as shown in FIG. 2. For example, projections 115*a* and 135*a* protruding a predetermined height may be formed on the bottom surface 115 of the plug 11, and the second latch 523 may be provided in the shape of loops to be locked and fastened with the projections 115*a* and 135*a*. Further, a plurality of second latches 523 may be provided on the bottom surface 115 of the plug 11.

Although two second latches 523 are formed in the present example embodiment, three or more second latches 523 may be formed, or only a single second latch 523 may be formed. Further, the position of the second latches 523 is not limited to the bottom surface 115 of the plug 11. If it is possible to prevent interference with the first latch 513, the second latches 523 may also be coupled to the side surface 114 of the plug 11.

When the second block 520 is inserted into the plug 11, the second wire guides 522 may be inserted into the plug 11 and fasten the lower portion of the outer circumferences of the wires W1, and the second latch 523 may be fastened to the bottom surface 115 of the plug 11 and thereby elastically support the coupling state of the second block 520 and the plug 11.

Figure 5:
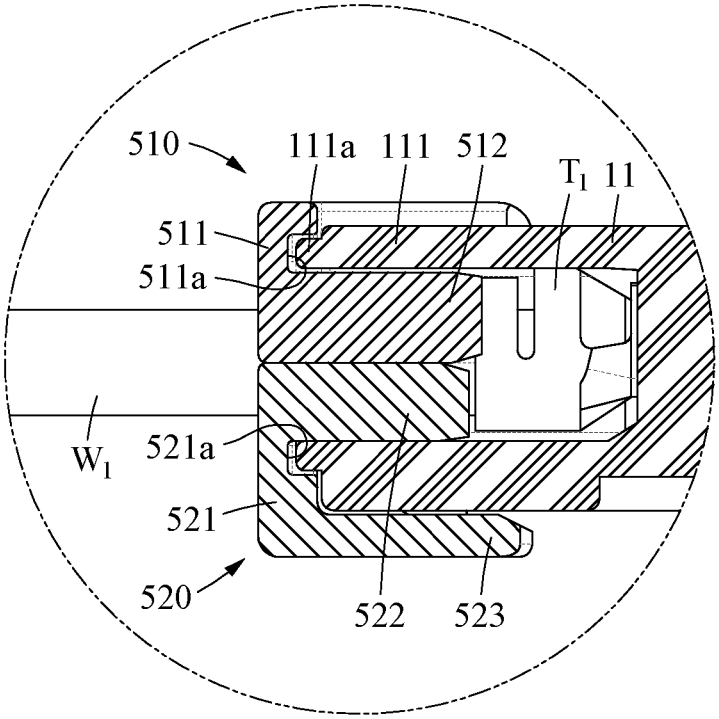
FIG. 5 is a detail view of a portion A of FIG. 4.

When the TPA member 15 is coupled to the plug 11, end portions of the first and second wire guides 512 and 522 may push the receptacle terminal T1 (or the tap terminal T2) into the plug 11 by contacting and pressurizing the receptacle terminal T1 (or the tap terminal T2), as shown in FIG. 5. In doing so, in the process of coupling the TPA member 15, the receptacle terminal T1 (and the tap terminal T2) may be pushed to the right position, and whether the receptacle terminal T1 (and the tap terminal T2) is coupled at the right position may be verified.

The first and second wire guides 512 and 522 may respectively prevent a separation of the receptacle terminal T1 from the plug 11 and a separation of the tap terminal T2 from the cap housing 13. That is, the first and second wire guides 512 and 522 may be positioned in the front with respect to a direction in which the receptacle terminal T1 coupled to the plug 11 and the tap terminal T2 coupled to the cap housing 13 are separated. Thus, when the wires W1 and W2 are pulled by external forces, the first and second wire guides 512 and 522 may prevent the separation of the receptacle terminal T1 and the separation of the tap terminal T2 respectively, and improve the holding force of the terminals T1 and T2.

In the TPA member 15 as shown in FIG. 5, the first and second wire guides 512 and 522 may be formed to fill the portions into which the receptacle terminal T1 and the tap terminal T2 are inserted. Thus, the first and second wire guides 512 and 522 may seal the plug 11 and the cap housing 13.

The radius of the wire connecting grooves 512*a* and 522*a* may be approximately less than the radius of the wires W1 and W2. That is, the inner diameter of holes formed by the wire connecting grooves 512*a* and 522*a* when the first and second blocks 510 and 520 engage may be less than the outer diameter of the wires W1 and W2. In doing so, the wires W1 and W2 may be pressurized in the wire connecting grooves 512*a* and 522*a* when the first and second blocks 510 and 520 are coupled to the plug 11 (or the cap housing 13), whereby a foaming member infiltrating into the connector assembly 10 through the wires W1 and W2 may be prevented.

A structure for preventing the foaming member infiltrating into the connector assembly 10 may be formed at the portion in which the TPA member 15 and the plug 11 (and the cap housing 13) are coupled. A protruding wall 111*a* (and a protruding wall 131*a*) protruding a predetermined height may be formed on the first end portion 111 (and the first end portion 131) of the plug 11 (and the cap housing 13), as shown in FIGS. 3-5, and grooves 511*a* and 521*a* into which the protruding wall 111*a* is to be inserted may be formed on inner sides of the first and second frames 511 and 521 in the TPA member 15. For example, the protruding wall 111*a* may be provided in the shape of a closed curve protruding toward the TPA member 15 along the perimeter of the first end portion 111 (and the first end portion 131) of the plug 11 (and the cap housing 13) and continuing along the entire perimeter of the first end portion 111 (and the first end portion 131).

When the TPA member 15 is coupled to the plug 11, the protruding wall 111*a* may be inserted into the groove 511*a*, whereby the hermeticity between the TPA member 15 and the plug 11 may increase. That is, the structure, in which the TPA member 15 is coupled to the plug 11 (and the cap housing 13) when the protruding walls 111*a* and 131*a* of the plug 11 and the cap housing 13 are inserted into the grooves 511*a* and 521*a* formed in the TPA member 15, may have a sealing effect of preventing the foaming member infiltrating into the connector assembly 10.

A method of assembling the TPA member 15 will be described with reference to FIGS. 6A-7.

In an embodiment, the TPA member 15 may be formed as an integral body in which the first block 510 and the second block 520 are connected, so as to be easily manufactured and easily assembled with the plug 11 (and the cap housing 13). For example, as shown in FIG. 6A, the first block 510 and the second block 520 may be formed as an integral body by being connected through a hinge-type connector 530. As shown in FIG. 7, the first block 510 and the second block 520 may be formed as an integral body by being connected through a loop-type connector 540.

The TPA member 15 may be assembled in a manner that one of the first block 510 and the second block 520 is first inserted into the plug 11 and then the other one is inserted into the plug 11, irrespective of the order of coupling the first block 510 and the second block 520.

Figure 6A:
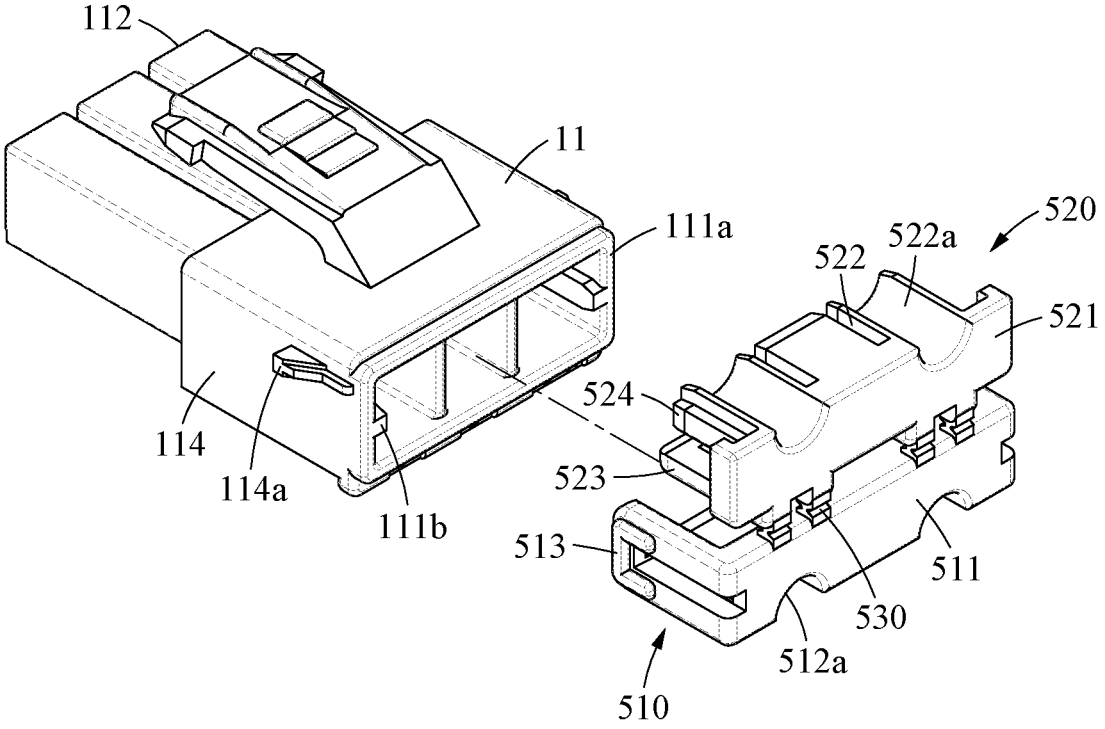
FIG. 6A is an exploded perspective view of a plug, a first block, and a second block according to an embodiment.
Figure 6B:
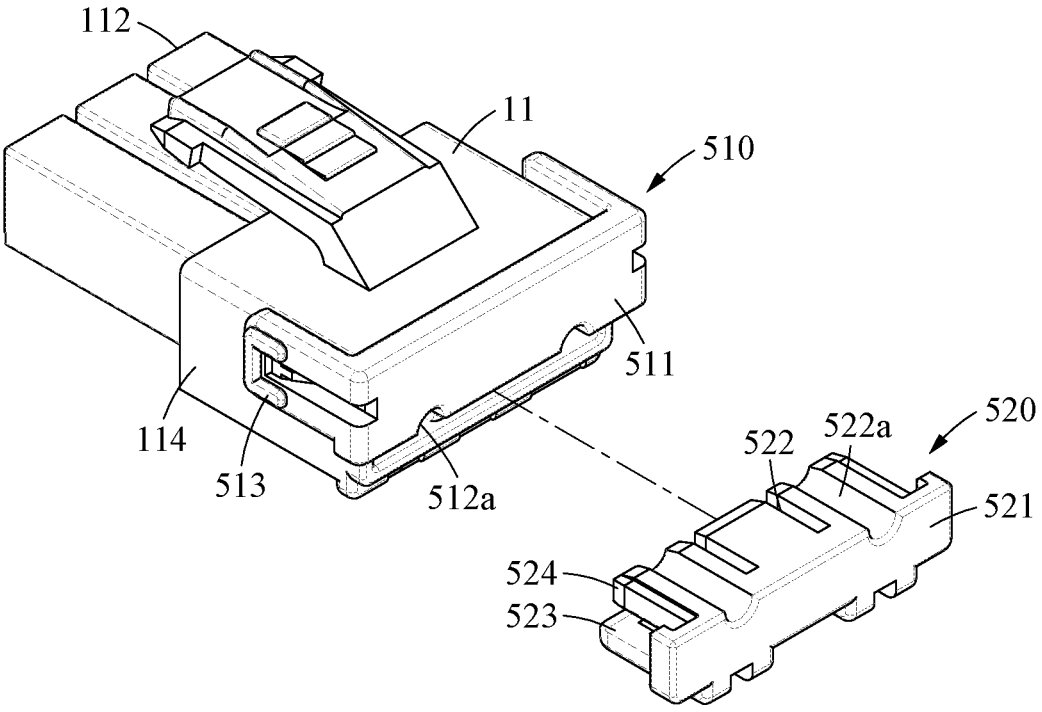
FIG. 6B is a perspective view of a step of a method of assembling the plug, the first block, and the second block of FIG. 6A.

First, as shown in FIGS. 6A and 6B, the connector 530 may be in the shape of a hinge connecting the first and second blocks 510 and 520. The first and second blocks 510 and 520 may be turned over and disposed up and down with the respective wire connecting grooves 512*a* and 522*a* facing opposite directions, and the hinge-type connector 530 may be formed therebetween.

The connector 530 may connect the first block 510 and the second block 520, thereby enabling the first and second blocks 510 and 520 to be manufactured at the same time and preventing a loss of the blocks 510 and 520 during the process of assembling the blocks 510 and 520 with the plug 11 or the cap housing 13 corresponding to the coupling target. Further, the connector 530 may be easily cut and enable a predetermined elastic deformation between the first and second blocks 510 and 520.

The process of assembling the TPA member 15 will now be described.

First, as shown in FIG. 6A, in a state in which the first block 510 and the second block 520 are connected by the connector 530, one of the first block 510 and the second block 520 is inserted into and coupled to the plug 11 (or the cap housing 13). Then, as shown in FIG. 6B, the first block 510 and the second block 520 may be separated by cutting the connector 530, and the other one separated may be coupled to the plug 11 (or the cap housing 13).

Interference preventing guides 111*b* may be formed on inner side surfaces of the first end portion 111 of the plug 11, as shown in FIG. 6A. For example, the interference preventing guides 111*b* may be formed at positions corresponding to boundary portions at which the first block 510 and the second block 520 face each other, formed in a length corresponding to a longitudinal direction of the wire guides 512 and 522 of the first and second blocks 510 and 520, and formed to protrude a predetermined height. Further, the first block 510 and the second block 520 may include guides 514 and 524, shown in FIG. 3, provided in the form of protruding portions or stepped portions to be guided by engaging with the interference preventing guides 111*b*.

By forming interference preventing guides 111 in the plug 11 and the cap housing 13, the interference preventing guides 111 may maintain a position of a first coupled block when coupling the first block 510 and the second block 520 to the plug 11 (or the cap housing 13), and prevent the subsequently coupled block from being interfered with the first coupled block.

Although FIG. 6A illustrates the interference preventing guides 111*b* provided only on the first end portion 111 of the plug 11, interference preventing guides may also be formed likewise on the first end portion 113 of the cap housing 13.

Figure 7:
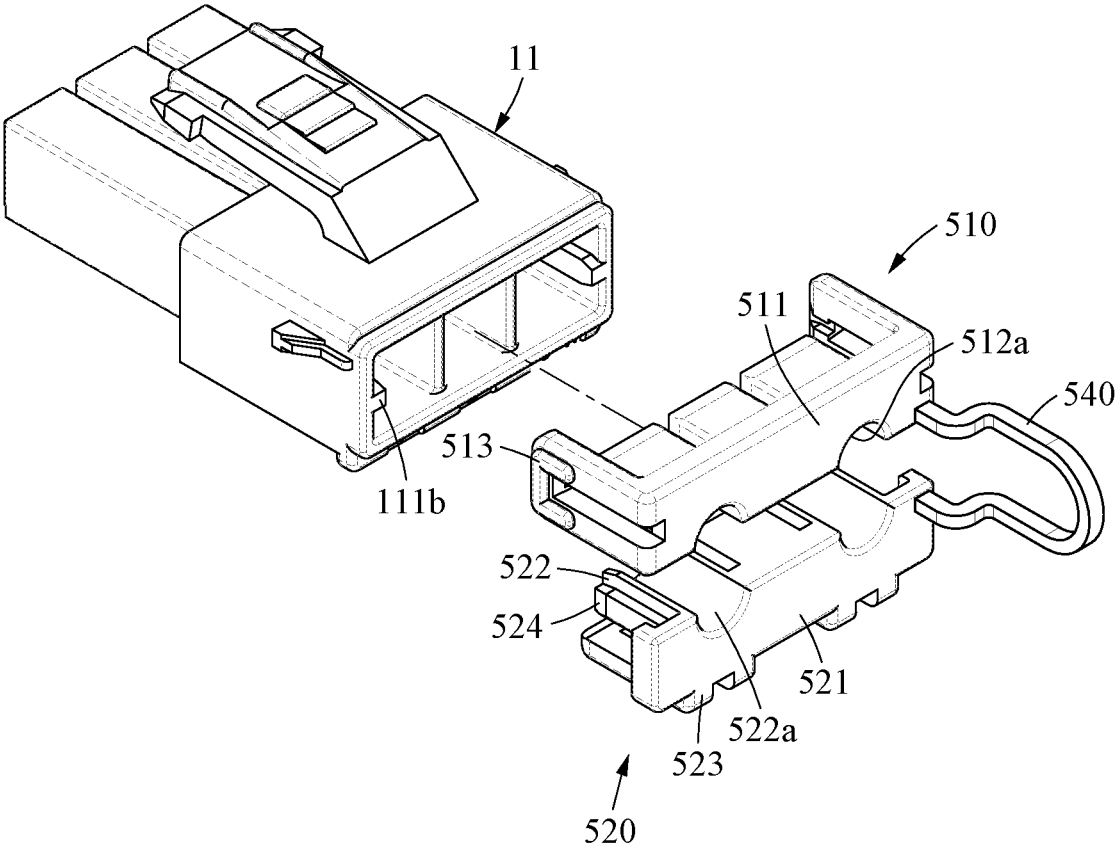
FIG. 7 is an exploded perspective view of a plug, a first block, and a second block according to another embodiment.

As shown in FIG. 7, a connector 540 may be provided approximately in the shape of an elastically deformable loop connecting the first and second blocks 510 and 520. In a state in which the wire connecting grooves 512*a* and 522*a* are disposed to face each other, the first and second blocks 510 and 520 may be connected through the connector 540 formed in the shape of a loop or strip on the outer sides of the first and second blocks 510 and 520.

The connector 540 of FIG. 7 may also enable the first and second blocks 510 and 520 to be manufactured at the same time by connecting the first block 510 and the second block 520, and simplify the assembly process by enabling the first and second blocks 510 and 520 to be coupled at the same time during the process of assembling the blocks 510 and 520 with the plug 11 or the cap housing 13 corresponding to the coupling target. Further, the connector 540 may be easily cut and enable an elastic deformation between the first and second blocks 510 and 520.

The TPA member 15 may be assembled in a manner that one of the first block 510 and the second block 520 connected by the connector 540 is first inserted into and coupled to the plug 11 (or the cap housing 13). Then, the other one may be coupled to the plug 11 (or the cap housing 13), and the connector 540 may be cut outside of the plug 11, as similarly described above.

By coupling the TPA member 15 to the plug 11 and the cap housing 13, a foaming member infiltrating into the connector assembly 10 through the first end portion 111 of the plug 11 and the first end portion 131 of the cap housing 13 may be prevented. Further, the foaming member infiltrating into the connector assembly 10 may be prevented through the coupling structures of the constituent elements, without a separate sealing member.

In an embodiment, a home appliance includes the connector assembly 10.

The effects of the connector assembly 10 and the home appliance including the connector assembly 10 are not limited to the above-mentioned effects. Other unmentioned effects can be clearly understood from the above description by those having ordinary skill in the technical field to which the present disclosure pertains.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A connector assembly, comprising:

a cap housing in which a first terminal is disposed;

a plug in which a second terminal is disposed, the plug having a first end portion and a second end portion opposite the first end portion, the second end portion inserted into the cap housing, a first end portion of the cap housing and the first end portion of the plug to which a wire is connected are each a coupling target;

a terminal position assurance (TPA) member attachable to the coupling target of either the cap housing or the plug, the TPA member including a first block and a second block partitioned from one another in a circumferential direction of the wire, with the TPA member disposed at the coupling target of one of the cap housing or the plug, the first block and the second block are each independently insertable and attachable to the coupling target after the other one of the first block or the second block is inserted and attached to the coupling target; and a connector connecting the first block and the second block, the connector is one of cut or elastically deformed after at least one of the first block or the second block is coupled to the coupling target.

2. The connector assembly of claim 1, with the TPA member attached to the coupling target of one of the cap housing or the plug, the first block has a first frame coupled to block a first end portion of the coupling target, a first wire guide coupled to an outer circumferential surface of the wire, and a first latch fastened to the coupling target, the second block has a second frame coupled to block the first end portion of the coupling target, a second wire guide corresponding to the first wire guide and coupled to a remaining outer circumferential surface of the wire, and a second latch fastened to the coupling target.

3. The connector assembly of claim 2, wherein the first frame and the second frame are positioned on a same plane when the TPA member is coupled to the coupling target.

4. The connector assembly of claim 3, wherein the coupling target has a protruding wall at the first end portion along an edge contacting the TPA member, the protruding wall protruding toward the TPA member, the first frame and the second frame each have a groove into which the protruding wall is inserted.

5. The connector assembly of claim 4, wherein the protruding wall has a shape of a closed curve continuing along an entire perimeter of the first end portion of the coupling target.

6. The connector assembly of claim 2, wherein the first wire guide and the second wire guide extend from the first frame and the second frame in a direction in which the first wire guide and second wire guide are coupled to the coupling target, an outer circumferential surface of each of the first wire guide and the second wire guide seals a portion of the coupling target into which the first terminal and the second terminal are respectively inserted.

7. The connector assembly of claim 6, wherein the first wire guide and the second wire guide push a terminal provided on the wire into the coupling target by contacting and pressurizing an end portion of the terminal when inserted into the coupling target.

8. The connector assembly of claim 6, wherein the first wire guide and the second wire guide each have a plurality of wire connecting grooves extending parallel in a longitudinal direction of the wire and independently coupled to a plurality of wires.

9. The connector assembly of claim 2, wherein the first block and the second block are disposed with the first wire guide and the second wire guide facing opposite directions, the connector is a hinge connecting the first block and the second block.

10. The connector assembly of claim 2, wherein the first block and the second block are disposed with the first wire guide and the second wire guide facing each other, the connector is a loop connecting the first block and the second block.

11. The connector assembly of claim 2, wherein the coupling target has a protruding portion locked with the first latch.

12. The connector assembly of claim 11, wherein a pair of first latches are locked with a pair of sides of the coupling target.

13. The connector assembly of claim 2, wherein the coupling target has a projection locked with an end portion of the second latch.

14. The connector assembly of claim 13, wherein the second latch is disposed at a position other than a position of the first latch on a perimeter of the coupling target such that the TPA member is attachable to the coupling target in only a single orientation.

15. The connector assembly of claim 14, wherein the second latch is disposed on a bottom surface of the perimeter of the coupling target.

16. The connector assembly of claim 14, wherein a plurality of second latches are disposed on a same surface of the perimeter of the coupling target.

17. The connector assembly of claim 1, wherein the plug has a first locking portion on an outer side, the cap housing has a second locking portion capable of being fastened to the first locking portion.

18. The connector assembly of claim 17, wherein the first locking portion has a shape of a cantilever extending in a direction in which the first locking portion is coupled to the cap housing and has an elasticity.

19. The connector assembly of claim 18, wherein the first locking portion includes a latch frame in the shape of the cantilever extending toward the cap housing and a plurality of movable portions parallel with the latch frame on a pair of sides of the latch frame, the movable portions are elastically deformable.

20. The connector assembly of claim 19, wherein the second locking portion has a stopper protruding from a surface of the cap housing, the stopper contacting an end portion of the latch frame, and a plurality of securing protrusions to be coupled to the movable portions.

21. The connector assembly of claim 20, wherein the securing protrusions are formed on a plurality of inner sides of a partition wall outside of the stopper, the movable portions are a plurality of hooks protruding outward from an end portion thereof.

22. A home appliance, comprising:

a connector assembly including a cap housing in which a first terminal is disposed, a plug in which a second terminal is disposed, and a terminal position assurance (TPA) member, the plug having a first end portion and a second end portion opposite the first end portion, the second end portion inserted into the cap housing, a first end portion of the cap housing and the first end portion of the plug to which a wire is connected are each a coupling target, the TPA member is disposed at the coupling target, the TPA member including a first block and a second block partitioned from one another in a circumferential direction of the wire and along a common plane such that the first block and the second block are freely moveable with respect to one another in an insertion direction of the TPA member into either the cap housing or the plug, with the first block and the second block inserted into either the cap housing or the plug, the first block and the second block are freely moveable relative to one another in a direction opposite the insertion direction.

23. The home appliance of claim 22, wherein, with first block and the second block inserted into either the cap housing or the plug, no surfaces of the first block and the second block oppose one another in the direction of insertion or the direction opposite the direction of insertion.

24. A connector assembly, comprising:

a cap housing in which a first terminal is disposed;

a plug in which a second terminal is disposed, the plug having a first end portion and a second end portion opposite the first end portion, the second end portion inserted into the cap housing, a first end portion of the cap housing and the first end portion of the plug to which a wire is connected are each a coupling target;

a terminal position assurance (TPA) member attachable to the coupling target of either the cap housing or the plug, the TPA member including:

a first block having a first frame coupled to block a first end portion of the coupling target of one of the cap housing or the plug, a first wire guide coupled to an outer circumferential surface of the wire, and a first latch attachable to the coupling target of the one of the cap housing or the plug; and a second block partitioned from the first block in a circumferential direction of the wire and having a second frame coupled to block the first end portion of the coupling target of the one of the cap housing or the plug, a second wire guide corresponding to the first wire guide and coupled to a remaining outer circumferential surface of the wire, and a second latch attachable to the coupling target of the one of the cap housing or the plug; and a plurality of interference preventing guides disposed on a plurality of inner side surfaces of the first end portion of the plug and the first end portion of the cap housing, the interference preventing guides protrude in a direction in which the first block and the second block are coupled.

25. The connector assembly of claim 24, wherein the first block and the second block each have a plurality of guides corresponding to the interference preventing guides.

* * * * *